US009366394B2

(12) United States Patent
Musser et al.

(10) Patent No.: US 9,366,394 B2
(45) Date of Patent: Jun. 14, 2016

(54) AUTOMOTIVE LED HEADLIGHT COOLING SYSTEM

(71) Applicant: Flextronics AP, LLC, Broomfield, CO (US)

(72) Inventors: Jordon Musser, Dallas, TX (US); Chris Stratas, Burlingame, CA (US)

(73) Assignee: Flextronics AP, LLC, Broomfield, CO (US)

( * ) Notice: Subject to any disclaimer, the term of this patent is extended or adjusted under 35 U.S.C. 154(b) by 0 days.

(21) Appl. No.: 14/502,805

(22) Filed: Sep. 30, 2014

(65) Prior Publication Data

US 2015/0016123 A1 Jan. 15, 2015

Related U.S. Application Data

(63) Continuation-in-part of application No. 13/921,067, filed on Jun. 18, 2013.

(60) Provisional application No. 61/665,179, filed on Jun. 27, 2012, provisional application No. 61/673,660, filed on Jul. 19, 2012, provisional application No. 61/886,032, filed on Oct. 2, 2013.

(51) Int. Cl.

| | |
|---|---|
| ***F21K 99/00*** | (2010.01) |
| ***F21V 29/00*** | (2015.01) |
| ***F21S 8/10*** | (2006.01) |
| ***F21V 29/51*** | (2015.01) |
| *F21Y 101/02* | (2006.01) |
| *F21S 8/04* | (2006.01) |

(52) U.S. Cl.

CPC ..... *F21K 9/30* (2013.01); *F21S 48/115* (2013.01); *F21S 48/328* (2013.01); *F21V 29/51* (2015.01); *F21S 8/04* (2013.01); *F21S 48/326* (2013.01); *F21Y 2101/02* (2013.01)

(58) Field of Classification Search

CPC ..... F21S 48/328; F21S 48/115; F21S 48/326; F21S 8/04; F21V 29/51; F21V 29/70; F21V 29/83; F21V 29/004; F21V 29/74; H01L 23/42; H01L 23/427; H01L 23/46; H01L 23/473; F21K 9/30

USPC ..... 362/373, 294, 547, 345, 218, 264, 362/249.01, 249.02, 382

See application file for complete search history.

(56) References Cited

U.S. PATENT DOCUMENTS

| | | | |
|---|---|---|---|
| 4,069,497 | A | 1/1978 | Steidlitz |
| 4,712,160 | A | 12/1987 | Sato et al. |

(Continued)

FOREIGN PATENT DOCUMENTS

| | | | |
|---|---|---|---|
| WO | 2011093614 | A2 | 8/2011 |

*Primary Examiner* — Anh Mai
*Assistant Examiner* — Arman B Fallahkhair
(74) *Attorney, Agent, or Firm* — Haverstock & Owens LLP

(57) ABSTRACT

A lighting assembly includes a cooling system configured to enable the dissipation of a large amount of energy in the form of heat generated by a light source. The cooling system is configured as a gravity feed cooling loop that does not require a powered fluid pump. The light source can be a plurality of LEDs mounted on a printed circuit board (PCB). The PCB is aligned and mounted vertically onto an evaporator. The evaporator is configured to enable the vertical alignment of the PCB and to cool the PCB while in this vertical alignment. The vertical alignment of the PCB enables horizontal projection of light emitted by the LEDs, such as in an automotive headlight application.

18 Claims, 7 Drawing Sheets

(56) References Cited

U.S. PATENT DOCUMENTS 4,771,824 A * 9/1988 Rojey ..... F25B 9/006 165/104.13
4,899,256 A 2/1990 Sway-Tin
5,101,322 A 3/1992 Ghaem et al.
5,168,919 A * 12/1992 Berenholz ..... F28D 15/0233 165/104.33
5,235,491 A 8/1993 Weiss
5,272,599 A 12/1993 Koenan
5,295,044 A 3/1994 Araki et al.
5,365,403 A 11/1994 Vinciarelli et al.
5,838,554 A 11/1998 Lanni
5,890,794 A 4/1999 Abtahi et al.
5,920,458 A 7/1999 Azar
5,933,324 A 8/1999 Barrett
RE36,414 E 11/1999 Tickner
6,243,269 B1 6/2001 Dibene, II et al.
6,272,015 B1 8/2001 Mangtani
6,282,092 B1 8/2001 Okamoto et al.
6,369,328 B1 4/2002 Munakata
6,549,409 B1 4/2003 Saxelby et al.
6,775,162 B2 8/2004 Mihai et al.
6,795,315 B1 9/2004 Wu et al.
6,882,111 B2 4/2005 Kan et al.
7,208,833 B2 4/2007 Nobori et al.
7,210,832 B2 * 5/2007 Huang ..... F21V 29/004 165/104.26
7,259,403 B2 8/2007 Shimizu et al.
7,338,186 B1 3/2008 Wu et al.
7,455,444 B2 11/2008 Chien
7,641,370 B2 1/2010 Heine et al.
7,674,025 B2 3/2010 Liesener
7,682,853 B2 3/2010 Ashida
7,938,558 B2 5/2011 Wilcox et al.
8,055,023 B2 11/2011 Goto et al.
8,070,325 B2 12/2011 Zampini
8,128,260 B2 3/2012 Ariyoshi
8,227,269 B2 7/2012 Chen et al.
8,227,969 B2 7/2012 Yamaguchi et al.
8,231,254 B2 7/2012 Beck et al.
8,262,263 B2 * 9/2012 Dinh ..... F21K 9/00 165/104.21
8,378,559 B2 * 2/2013 Shuja ..... F21V 29/006 313/34
8,696,951 B2 4/2014 Takese et al.
2001/0042865 A1 11/2001 Oshio et al.
2001/0045297 A1 11/2001 Miller et al.
2002/0008963 A1 1/2002 DiBene, II et al.
2002/0075652 A1 * 6/2002 Berchowitz ..... F28D 15/0266 361/700
2002/0092160 A1 7/2002 McCullough
2004/0122606 A1 6/2004 Cohen et al.
2004/0144527 A1 7/2004 Yang et al.
2006/0186430 A1 8/2006 Park et al.
2006/0196642 A1 9/2006 Gharib
2006/0261970 A1 11/2006 Colacecchi
2007/0028626 A1 * 2/2007 Chen ..... F25B 25/00 62/6
2008/0048200 A1 2/2008 Mueller et al.
2008/0112176 A1 5/2008 Liesener
2008/0205075 A1 8/2008 Hikment et al.
2009/0179207 A1 7/2009 Chitnis et al.
2009/0272136 A1 11/2009 Knoll et al.
2010/0097780 A1 4/2010 Beatenbough et al.
2010/0295070 A1 11/2010 Su et al.
2010/0295077 A1 11/2010 Melman
2011/0048676 A1 * 3/2011 Toyoda ..... F28D 1/05366 165/104.21
2011/0063836 A1 3/2011 Salm
2011/0192574 A1 * 8/2011 Yoshikawa ..... F28D 15/0266 165/104.21
2011/0228517 A1 9/2011 Kawabalt et al.
2012/0019137 A1 1/2012 Sakarikas et al.
2012/0097985 A1 4/2012 Liu et al.
2012/0120667 A1 5/2012 Schenkl
2012/0205697 A1 8/2012 Kim et al.
2012/0218746 A1 8/2012 Winton
2013/0027906 A1 1/2013 Ueda et al.
2013/0050998 A1 2/2013 Chu et al.
2013/0182425 A1 7/2013 Seki et al.
2014/0001496 A1 1/2014 Musser et al.
2014/0003053 A1 1/2014 Musser et al.
2015/0016123 A1 1/2015 Musser et al.

* cited by examiner

AUTOMOTIVE LED HEADLIGHT COOLING SYSTEM

RELATED APPLICATIONS

This patent application is a continuation-in-part of the co-pending U.S. patent application Ser. No. 13/921,067, filed Jun. 18, 2013, and entitled "Cooling System for LED Device", by these same inventors. U.S. patent application Ser. No. 13/921,067 claims priority under 35 U.S.C. 119 (e) of the U.S. provisional application Ser. No. 61/665,179, filed Jun. 27, 2012, and entitled "LED LIGHTING" and U.S. provisional application Ser. No. 61/673,660, filed Jul. 19, 2012, and entitled "HIGH BAY LED LIGHTING AND HEAT DISSIPATION", both by these same inventors. This patent application also claims priority under 35 U.S.C. 119 (e) of the co-pending U.S. provisional application Ser. No. 61/886,032, filed Oct. 2, 2013, and entitled "Automotive Led Highlight Cooling System", by these same inventors. This application incorporates U.S. patent application Ser. No. 13/921,067, U.S. provisional application Ser. No. 61/665,179, U.S. provisional application Ser. No. 61/673,660 and U.S. provisional application Ser. No. 61/886,032, in their entireties by reference.

FIELD OF THE INVENTION

The present invention is generally directed to the field of light emitting diode (LED) lighting. More specifically, the present invention is directed to a cooling system for a LED device.

BACKGROUND OF THE INVENTION

A light-emitting diode (LED) is a semiconductor light source. LEDs are increasingly being used in a wide variety of lighting applications. LEDs continue growing in popularity due in part to their efficiency and extended lifetimes. In some high power applications, such as LEDs designed to operate at a few hundred watts, a lot of heat is generated, which needs to be dissipated.

SUMMARY OF THE INVENTION

A lighting assembly includes a cooling system configured to enable the dissipation of a large amount of energy in the form of heat generated by a light source. Heat is dissipated without heating surrounding components, such as power supply units and device electronics. The cooling system is configured as a gravity feed system that does not require a powered fluid pump. In some embodiments, the cooling loop is configured as a thermal siphon that uses a boiling fluid to transport heat between the evaporator and the radiator. In some embodiments, the evaporator also functions as a device chassis, which reduces the overall part count. In some embodiments, the light source is a plurality of LEDs mounted on a printed circuit board (PCB). The PCB is aligned and mounted vertically onto the evaporator. The evaporator is configured to enable the vertical alignment of the PCB and to cool the PCB while in this vertical alignment. The vertical alignment of the PCB enables horizontal projection of light emitted by the LEDs, such as in an automotive headlight application.

In an aspect, a lighting assembly for cooling a light source is disclosed. The lighting assembly include a light source, an evaporator and a cooling loop. The light source has a vertically aligned thermal exchange surface. The evaporator has a side thermal exchange surface thermally coupled to the vertically aligned thermal exchange surface of the light source. The evaporator also has a reservoir and a fluid within the reservoir. The evaporator is configured such that at least a portion of the fluid is vaporized by heat transferred from the light source. The cooling loop is coupled to the evaporator. The cooling loop includes a transfer pipe coupled to the evaporator, a radiator coupled to the transfer pipe, and a return pipe coupled to the radiator and to the evaporator. The radiator is configured to receive vapor from the evaporator via the transfer pipe and to condense the vapor, and the radiator and the return pipe are configured to gravity feed fluid to the evaporator. In some embodiments, the radiator includes a first end coupled to the transfer pipe and a second end, and the radiator is aligned along a non-horizontal plane with the first end positioned higher than the second end. In some embodiments, the return pipe includes a first end coupled to the second end of the radiator and a second end coupled to the evaporator, the return pipe is configured and aligned having the first end of the return pipe positioned higher than the second end of the return pipe. In some embodiments, the transfer pipe is configured to be vertically ascending. In some embodiments, the radiator is a finned radiator. In some embodiments, the transfer pipe is a finned pipe. In some embodiments, the fluid is a fluid mixture having at least a first fluid and a second fluid having a higher boiling temperature than the first fluid, wherein the first fluid includes the portion of the fluid vaporized by heat transferred from the light source. In some embodiments, the evaporator and the fluid mixture are configured such that when the portion of the fluid is vaporized by heat transferred from the light source a boiling fluid is formed, further wherein the evaporator and the transfer pipe are configured such that the boiling fluid is siphoned from the evaporator to the radiator. In some embodiments, the light source includes a plurality of light emitting diodes. In some embodiments, the light source also includes a printed circuit board coupled to the plurality of light emitting diodes. In some embodiments, the light source is aligned to emit a horizontal projection of light.

In another aspect, another lighting assembly for cooling a light source is disclosed. The lighting assembly includes a light source, an evaporator, a transfer pipe, a radiator and a return pipe. The light source has a vertically aligned thermal exchange surface. The evaporator has a side thermal exchange surface thermally coupled to the vertically aligned thermal exchange surface of the light source. The evaporator includes a reservoir and a fluid within the reservoir. The evaporator is configured such that at least a portion of the fluid is vaporized by heat transferred from the light source. The transfer pipe is coupled to the evaporator such that vapor formed in the evaporator rises through the transfer pipe. The radiator is coupled to the transfer pipe. The radiator includes a first end coupled to the transfer pipe and a second end. The radiator is aligned along a non-horizontal plane with the first end positioned higher than the second end. The radiator is configured such that vapor received from the transfer pipe is condensed to fluid and the fluid is gravity fed to the second end. The return pipe is coupled to the radiator. The return pipe includes a first end coupled to the second end of the radiator and a second end coupled to the evaporator. The return pipe is configured and aligned having the first end of the return pipe positioned higher than the second end of the return pipe such that fluid output from the second end of the radiator is gravity fed to the evaporator. In some embodiments, the transfer pipe is configured to be vertically ascending. In some embodiments, the radiator is a finned radiator. In some embodiments, the transfer pipe is a finned pipe. In some embodiments, the fluid is a fluid mixture having at least a first fluid and a second fluid having a higher boiling temperature than the first fluid, wherein the first fluid includes the portion of the fluid vaporized by heat transferred from the light source. In some embodiments, the evaporator and the fluid mixture are configured such that when the portion of the fluid is vaporized by heat transferred from the light source a boiling fluid is formed, further wherein the evaporator and the transfer pipe are configured such that the boiling fluid is siphoned from the evaporator to the radiator. In some embodiments, the light source includes a plurality of light emitting diodes. In some embodiments, the light source also includes a printed circuit board coupled to the plurality of light emitting diodes. In some embodiments, the light source is aligned to emit a horizontal projection of light.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Embodiments of the present application are directed to a lighting assembly. Those of ordinary skill in the art will realize that the following detailed description of the lighting assembly is illustrative only and is not intended to be in any way limiting. Other embodiments of the lighting assembly will readily suggest themselves to such skilled persons having the benefit of this disclosure.

Reference will now be made in detail to implementations of the lighting assembly as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
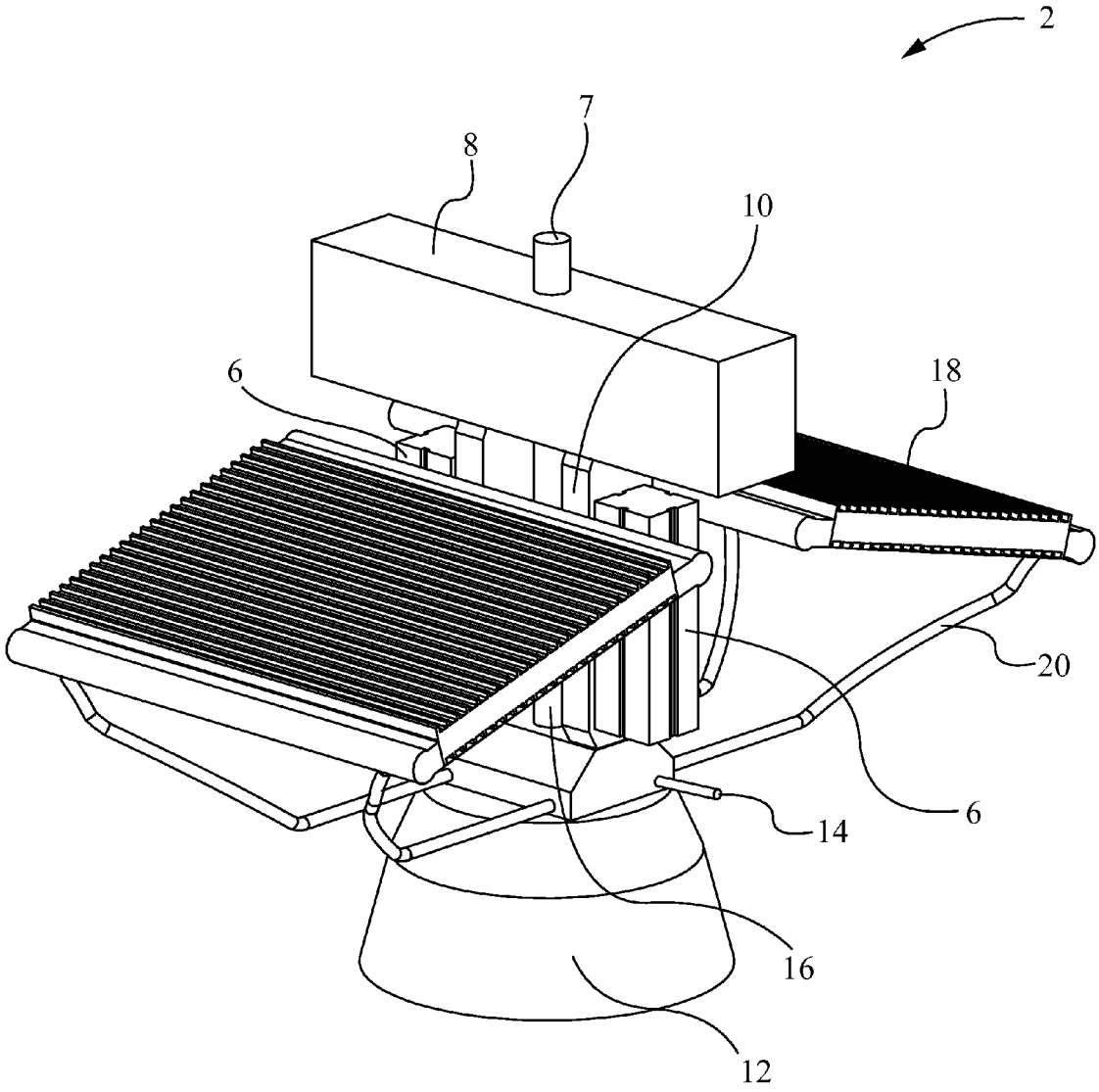
FIG. 1 illustrates a perspective view of a lighting assembly according to an embodiment.
Figure 2:
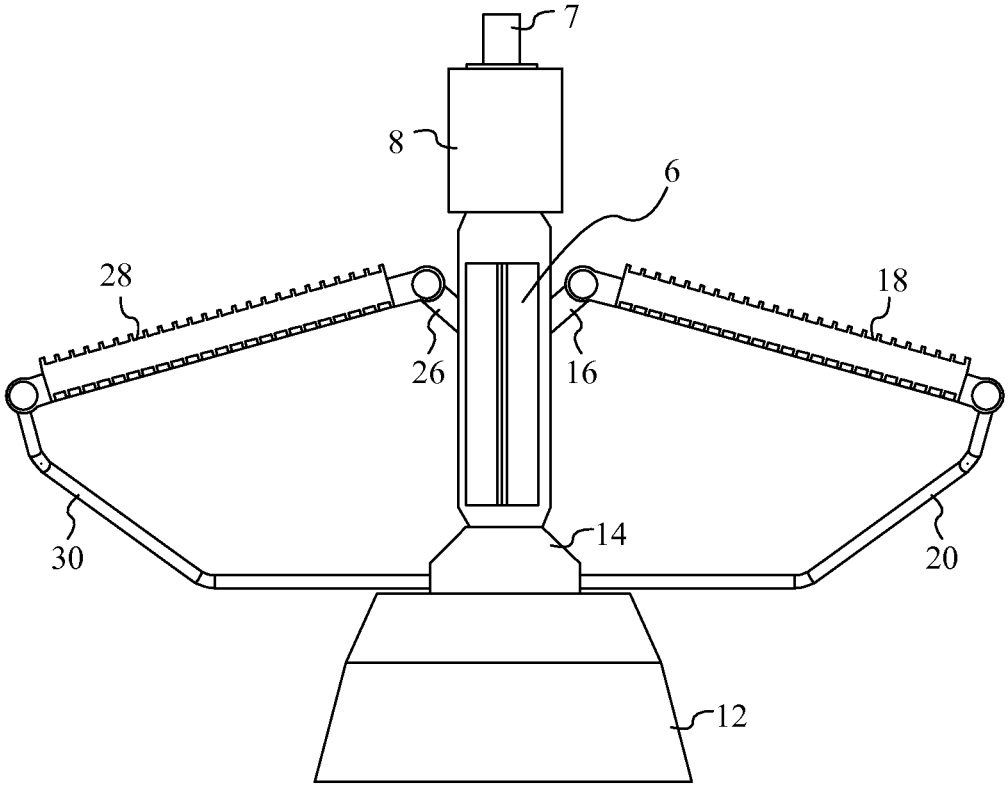
FIG. 2 illustrates a side view of the lighting assembly of FIG. 1.

FIG. 1 illustrates a perspective view of a lighting assembly according to an embodiment. The lighting assembly includes a light source, a cooling system, one or more power supply units, device electronics, and a mounting structure. The cooling system includes one or more cooling loops, each cooling loop including an evaporator, a vertically ascending pipe, a radiator and a return pipe. The exemplary cooling system shown in FIG. 1 includes two cooling loops, each cooling loop shares a common evaporator 14. FIG. 2 illustrates a side view of the lighting assembly 2 of FIG. 1. A first cooling loop includes the evaporator 14, a vertically ascending pipe 16, a radiator 18, and a return pipe 20. A second cooling loop includes the evaporator 14, a vertically ascending pipe 26, a radiator 28 and a return pipe 30. FIGS. 1 and 2 also show an optional reflector 12. The light source is positioned within the reflector 12. The first cooling loop and the second cooling loop are each closed loop. Although two closed loop cooling systems are shown in the lighting assembly of FIGS. 1 and 2, it is understood that a lighting assembly can be configured to include a single closed loop cooling system or three or more closed loop cooling systems. The lighting assembly includes a mounting structure 10 coupled to the evaporator 14 and to device electronics 8. In this exemplary configuration, the lighting assembly includes two power supplies 6. The power supplies 6 can be mounted to the mounting structure 10, a housing of the device electronics 8, the evaporator 14, the pipes 16 and 26 or some combination thereof. An external mounting base 7 is coupled to the housing of the device electronics 8. The external mounting base 7 is used to mount the lighting assembly. In some embodiments, the external mounting base 7 is configured to receive a conduit, which in turn is mounted to an external support, such as a ceiling.

The cooling system is configured to enable the dissipation of a large amount of energy in the form of heat without heating surrounding components, such as the one or more power supply units and device electronics. In some embodiments, the cooling loop is configured as a thermal siphon that uses a boiling fluid to transport heat between the evaporator and the radiators. In some embodiments, the evaporator also functions as a device chassis, which reduces the overall part count. In some embodiments, the light source is a plurality of LEDs. LEDs have a well defined thermal performance and therefore operate properly within a defined temperature range. The cooling system is designed to maintain the LED temperatures within the defined temperature range. The one or more power supply units are arranged such that heat generated by the one or more power supply units does not negatively impact the thermal performance of the LED light source.

The evaporator 14 is a fluid-based heat exchanger that conceptually functions as a boiling unit. In some embodiments, the evaporator 14 includes a fluid reservoir that is filled, or partially filled, with a fluid or fluid mixture, herein referred to collectively as a fluid. The evaporator 14 is thermally coupled to the light source such that heat generated by the light source is transferred to the fluid within the evaporator 14. The heat causes fluid in the evaporator 14 to evaporate. The resulting vapor rises through the vertically ascending pipes 16, 26 to the radiators 18, 28. In some embodiments, each pipe 16, 26 includes a first portion that extends straight up from the evaporator 14 and a second portion that bends at an angle from completely vertical, but not horizontal, which is coupled to the radiator 18, 28. In some embodiments, the angle of the second portion is 30 to 60 degrees relative to vertical or the first portion. The portion of pipes 16, 26 shown in FIG. 2 is the second, angled portion. It is understood that the pipes 16, 26 can be alternatively shaped so as to provide an upward path from the evaporator 14 to the radiator 18, 28. In some embodiments, the pipes 16, 20 are configured with fins, and the pipe with fins is made of thermally conductive materials. Heat from the rising vapor can be shed during transport through the pipes 16, 26. In some embodiments, the pipes 16, 26 are configured having an oval cross-section to accommodate the internal pressure.

The radiator 18 is aligned at a decline, or downward angle relative to horizontal, such that one end is higher than the other end. The pipe 16 is coupled to a top portion of the radiator 18 and the return pipe 20 is coupled to a bottom portion of the radiator 18. In some embodiments, the pipe 16 is coupled to an end of the top portion of the radiator 18. In some embodiments, the return pipe 20 is coupled to an end of the bottom portion of the radiator 18. Vapor entering the radiator 18 from the pipe 16 condenses and the liquid flows downward through the radiator 18 to the return pipe 20. Due to the declining orientation of the radiator 18, liquid within the radiator is gravity fed toward the bottom end and to the return pipe 20. The return pipe 20 is aligned at a decline such that one end is higher than the other end such that liquid received from the radiator 18 is gravity fed to the evaporator 14.

The second cooling loop is configured similarly as the first cooling loop. The radiator 28 is aligned at a decline, or downward angle relative to horizontal, such that one end is higher than the other end. The pipe 26 is coupled to a top portion of the radiator 28 and the return pipe 30 is coupled to a bottom portion of the radiator 28. In some embodiments, the pipe 26 is coupled to an end of the top portion of the radiator 28. In some embodiments, the return pipe 30 is coupled to an end of the bottom portion of the radiator 28. Vapor entering the radiator 28 from the pipe 16 condenses and the liquid flows downward through the radiator 28 to the return pipe 30. Due to the declining orientation of the radiator 28, liquid within the radiator is gravity fed toward the bottom end and to the return pipe 30. The return pipe 30 is aligned at a decline such that one end is higher than the other end such that liquid received from the radiator 28 is gravity fed to the evaporator 14.

The cooling loops are described above has having separate pipes 16 and 26 that couple the evaporator to the radiators 18 and 28, respectively. Alternatively, the pipes 16 and 26 can include a common portion that splits for coupling to the radiators 18 and 28. For example, a single vertically ascending pipe can be coupled to the evaporator 14, and at a top portion of the pipe, the pipe branches, such as into two branches, each branch bends at an angle from completely vertical, but not horizontal. One or more branches are coupled to the radiator 18 and one or more branches are coupled to the radiator 28. Still alternatively, multiple separate pipes can be coupled between the evaporator 14 and a single radiator. For example, two or more pipes, each pipe similar to the pipe 16, can be coupled between the evaporator 14 and the radiator 18.

As shown in FIG. 1, each radiator 18 and 28 includes an input header coupled to the pipe 16 and 26, respectively. The input header laterally distributes the vapor received from the pipe. The radiator can also include one or more fluid conduits coupled to the input header and fins coupled to the fluid conduits. The fluid conduits can be arranged laterally and/or layered to form a vertical stack of fluid conduits, each layer separated by fins. The radiator can also include an output header coupled to the one or more fluid conduits. The output header is coupled to the return pipe. In general, the radiators are designed to dissipate the heat to the atmosphere using convection cooling without the need for fans blowing over the radiators.

In some embodiments, the fluid is a fluid mixture consisting of at least two different types of fluids that each evaporate at a different temperature. The thermal characteristics of the cooling system and fluid mixture are configured such that the heat supplied to the fluid within the evaporator is sufficient to evaporate one of the fluids, but insufficient to evaporate the second fluid. The evaporated fluid forms vapor bubbles within the remaining non-evaporated fluid mixture. In this manner, heat transferred to the fluid mixture results in a boiling fluid, a portion of which is a vapor and another portion of which is a liquid. The configuration of the fluid mixture and the vertically ascending pipes enables a pumping means whereby the boiling fluid, including the vapor and liquid forms of fluid mixture, rises from the evaporator 14, through the pipes 16 and 26, to the radiators 18 and 28. The vapor bubbles within the boiling fluid are used to siphon non-evaporated fluid up the pipes 16 and 26 and into the radiators 18 and 28. In this manner, a pumping means is integral to the cooling loop without including a discrete pumping component such as a powered pump. An example of such a pumping means is a bubble pump found in U.S. Patent Application Publication No. 2007/0273024, which is hereby incorporated in its entirety be reference. Although the boiling fluid includes a non-evaporated liquid component, this liquid component has been heated and as such the circulating liquid provides additional thermal transport from the evaporator to the radiator. In the case where the pipes 16 and 26 are finned pipes, heat from the rising boiling fluid can be shed during transport through the pipes 16 and 26.

Figure 6:
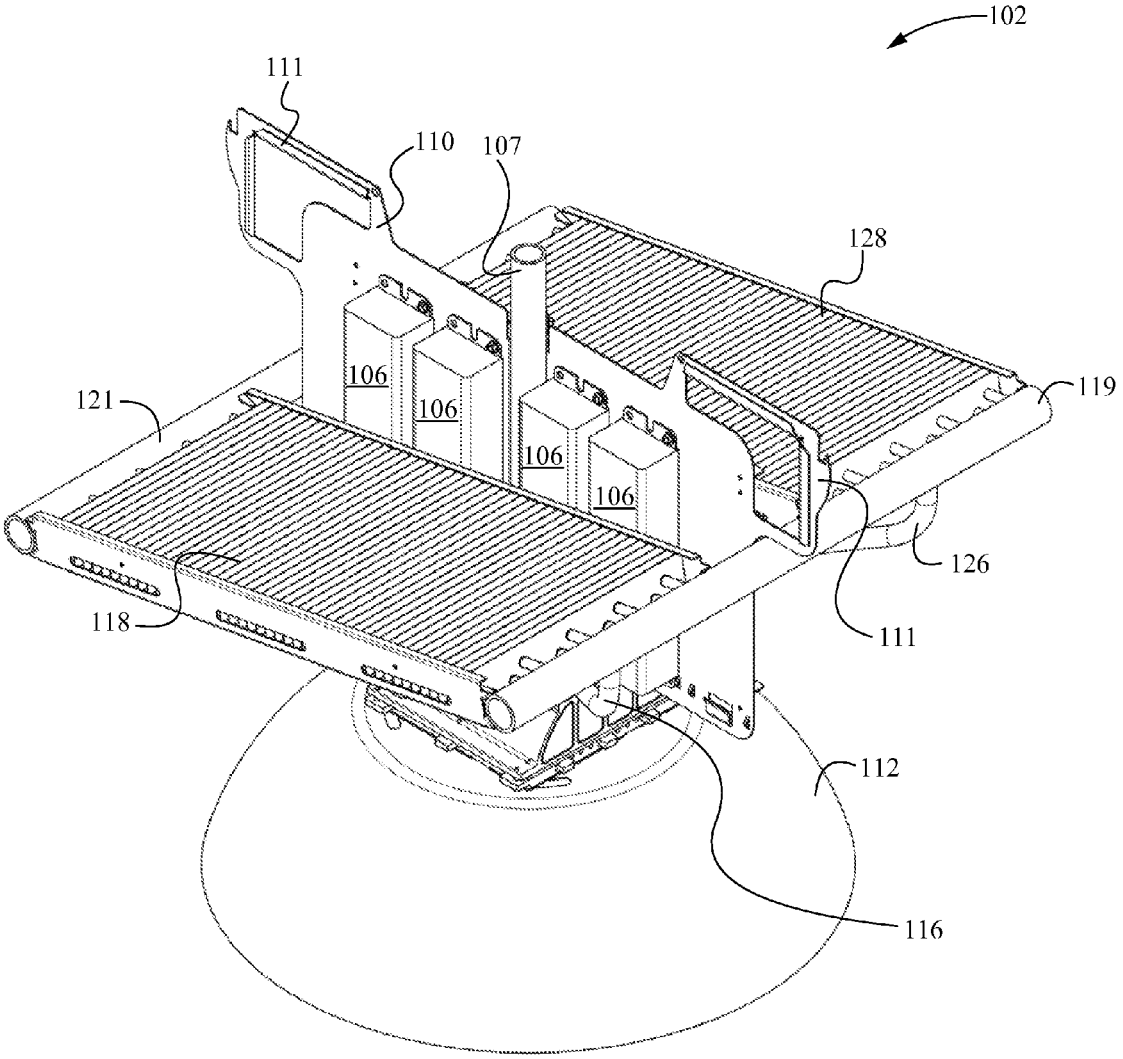
FIG. 6 illustrates a perspective view of a lighting assembly according to another embodiment.
Figure 7:
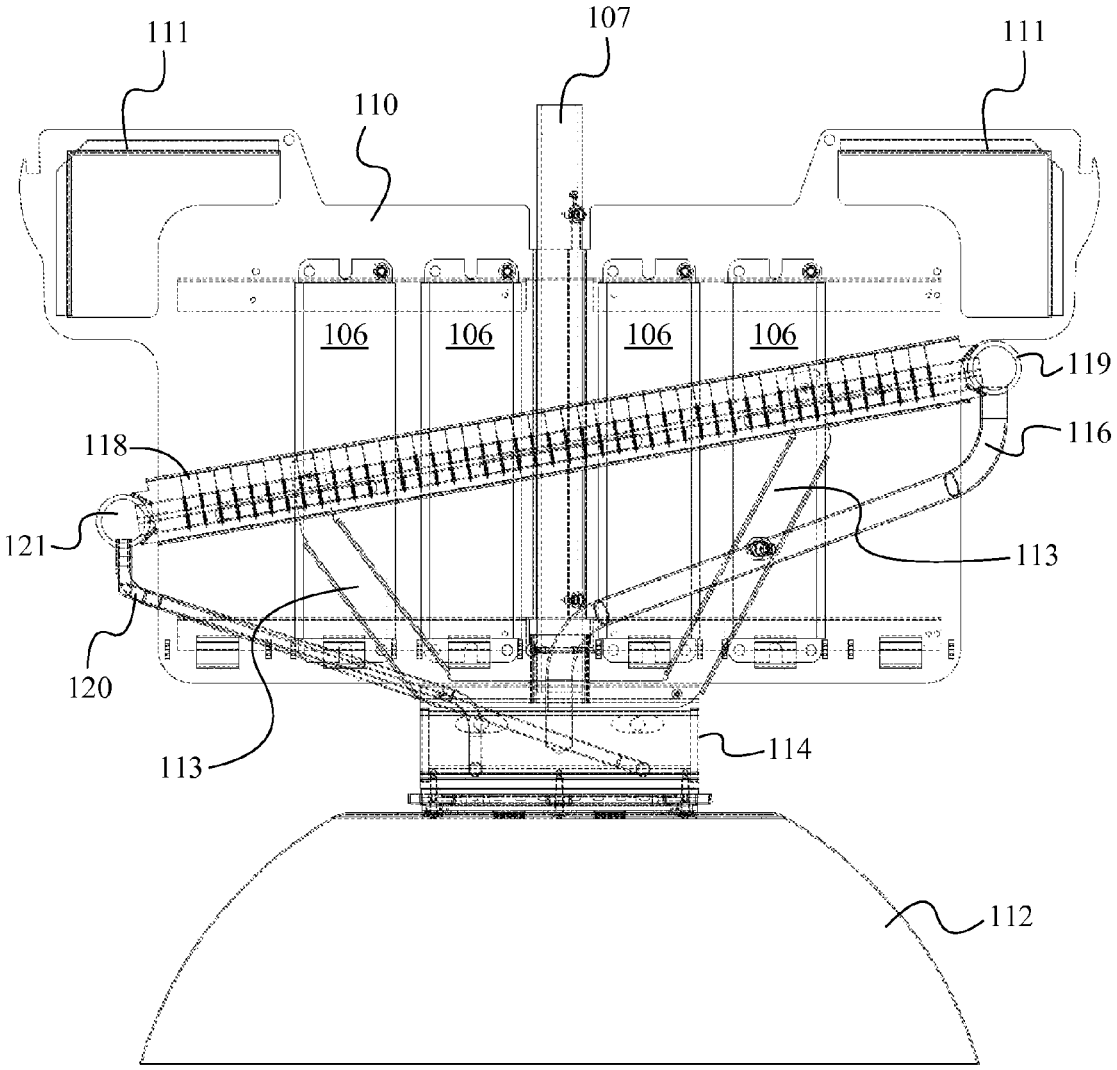
FIG. 7 illustrates a side view of the lighting assembly of FIG. 6.

Alternative configurations of the lighting assembly are also contemplated. FIG. 6 illustrates a perspective view of a lighting assembly according to another embodiment. The lighting assembly includes a light source, a cooling system, one or more power supply units, and a mounting structure. The cooling system includes one or more cooling loops, each cooling loop including an evaporator, a vertically ascending pipe, a radiator and a return pipe. The lighting assembly of FIG. 6 functions similarly as the lighting assembly of FIG. 1 to provide cooling for the light source. The exemplary cooling system shown in FIG. 6 includes two cooling loops, each cooling loop shares a common evaporator 114. FIG. 7 illustrates a side view of the lighting assembly 102 of FIG. 6. A first cooling loop includes the evaporator 114, a vertically ascending pipe 116, a radiator 118, and a return pipe 120. A second cooling loop includes the evaporator 114, a vertically ascending pipe 126, a radiator 128 and another return pipe (not shown). FIGS. 6 and 7 also show an optional reflector 112. The light source is positioned within the reflector 112. The first cooling loop and the second cooling loop are each closed loop. Although two closed loop cooling systems are shown in the lighting assembly of FIGS. 6 and 7, it is understood that a lighting assembly can be configured to include a single closed loop cooling system or three or more closed loop cooling systems.

As shown in FIG. 6, the radiator 118 and the radiator 128 are each coupled to an input header 119 and to an output header 121. In this manner, a single condensing unit is formed having two separate radiator portions coupled via common input and output headers. In the exemplary configuration shown in FIG. 6, separation of the radiators 118 and 128 forms a pathway therebetween within which accessory elements can be positioned. The vertically ascending pipes 116 and 126 are each coupled at one end to the evaporator 114 and at the other end to the input header 119. The return pipe 120 and the other return pipe (not shown) are each coupled at one end to the output header 121 and at the other end to the evaporator 114. The input header 119 laterally distributes the vapor received from the vertically ascending pipes 116 and 126. The radiators 118 and 128 can also include one or more fluid conduits coupled to the input header 119 and to the output header 121, and fins coupled to the fluid conduits. The fluid conduits can be arranged laterally and/or layered to form a vertical stack of fluid conduits, each layer separated by fins. The output header 121 collects the condensed liquid from the radiators 118 and 128.

The lighting assembly includes a mounting structure 110 coupled to the evaporator 114 and positioned in the pathway between the radiators 118 and 128. The mounting structure 110 includes handles 111 for carrying the lighting assembly. In this exemplary configuration, the lighting assembly includes four power supplies 106. The power supplies 106 can be mounted to the mounting structure 110, as shown, the evaporator 114, the vertically ascending pipes 116 and 126 or some combination thereof. An external mounting base 107 is coupled to the mounting structure 110 and/or to the evaporator 114. Bracing elements 113 provide additional support and couple the radiators 118 and 128 to the mounting structure 110, the external mounting base 107, the evaporator 114 or some combination thereof. The external mounting base 107 is used to mount the lighting assembly. In some embodiments, the external mounting base 107 is configured to receive a conduit, which in turn is mounted to an external support, such as a ceiling.

In the configuration shown in FIGS. 6 and 7, a separate device electronics and housing, such as device electronics 8 in FIGS. 1 and 2, is not included. In the configuration shown in FIGS. 6 and 7, device electronics are included as part of a light source assembly, such as the light source 36 shown in FIG. 3 and described below. It is understood that device electronics and housing such as the device electronics 8 in FIGS. 1 and 2 can be added to the lighting assembly 102, such as mounted to the mounting structure 110 and/or to the external mounting base 107.

Figure 3:
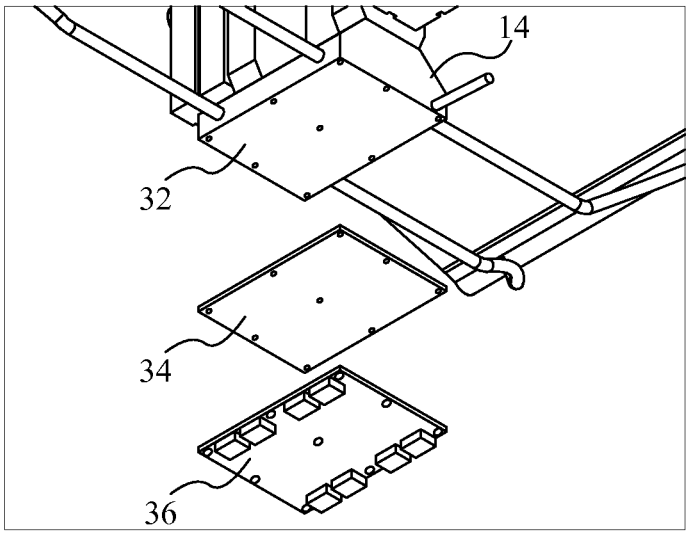
FIG. 3 illustrates a bottom perspective exploded view of the evaporator disassembled from an exemplary light source according to an embodiment.

As described above, the evaporator is configured to transfer heat from a light source coupled to the evaporator to fluid within the evaporator. FIG. 3 illustrates a bottom perspective exploded view of the evaporator 14 disassembled from an exemplary light source 36 according to an embodiment. The evaporator 14 includes a thermal exchange surface 32. As shown in FIG. 3, the thermal exchange surface 32 is a rectangular, planar surface. Alternatively, the surface can be shaped other than a rectangle. Preferably, the shape of the thermal exchange surface matches that of a corresponding thermal exchange surface of the light source. The thermal exchange surface 32 is made of a thermally conductive material, which can be the same or different than the material used to make the remainder of the evaporator. The light source 36 is thermally coupled to the thermal exchange surface 32 via a thermal interface material 34.

In some embodiments, the light source 36 is a plurality of LEDs mounted to a printed circuit board. Printed circuit boards are inherently flexible. Attaching such a flexible substrate to a rigid thermal exchange interface and achieving the requisite thermal interface between the two may require many fasteners, both along the perimeter and interior of the printed circuit board. The printed circuit board can be modified for enhanced rigidity. In some embodiments, the printed circuit board is bonded thermally and physically to a thicker, rigid substrate, such as a metal plate, to form a board assembly. The rigid substrate is made of a thermally conductive material, such as aluminum. As such, the board assembly provides structural rigidity and thermal conductance. Bonding the metal plate to the printed circuit board also provides improved thermal communication over the entire overlapping areas of the metal plate and printed circuit board. The board assembly is fastened to the thermal interface surface 32 of the evaporator 14 via the thermal interface material 34. The rigid board assembly can be attached to the thermal interface surface 32 using fewer fasteners than if the printed circuit board alone is attached to the thermal interface surface 32. For example, the board assembly can be attached to the thermal interface surface 32 using fasteners around the perimeter. No interior fasteners are needed in this case due to the rigidity of the board assembly. Due to the rigid structure, proper thermal communication is established across the entire board assembly and thermal interface surface even though fasteners are only sparsely applied, such as about the perimeter. Without the board assembly, mounting a printed circuit board may require a screw positioned every inch or so in a grid pattern to supply enough normal force to the printed circuit board to provide proper thermal communication with the thermal interface surface 32. In contrast, the rigid substrate of the board assembly provides continuous contact of the substrate in response to a reduced number of normal force points, such as along the perimeter.

The use of fewer fasteners provides a number of advantages including easier and faster assembly and lower costs. Additionally, fewer fasteners speeds the process of replacing a light source in an already installed lighting assembly. The board assembly is mounted to the evaporator 14 using any conventional mounting means including, but not limited to, screws, clamps, and/or brackets. To provide additional speed and ease for replacing an installed light source, the board assembly can be mounted using quick release latches or other mounting mechanisms that allow for quick and easy removal and replacement. In this manner, the rigid board assembly enables an installed lighting assembly to be "relampable" where the light source can be simply replaced.

In some embodiments, the thermal exchanging surface of the evaporator is a non-planar surface. In this alternative configuration, a contour of the thermal exchanging surface is configured to match that of the corresponding thermal exchange surface of the light source. In some embodiments, the light source is configured with a plurality of planar surfaces angled relative to each other. In an exemplary configuration, the light source is a multi-facet light source where each facet is a planar surface having a plurality of LEDs. Such a multi-facet light source is described in the co-pending U.S. patent application Ser. No. 13/921,028, filed Jun. 18, 2013, and entitled "Multi-Facet Light Engine", which is hereby incorporated in its entirety be reference.

Figure 4:
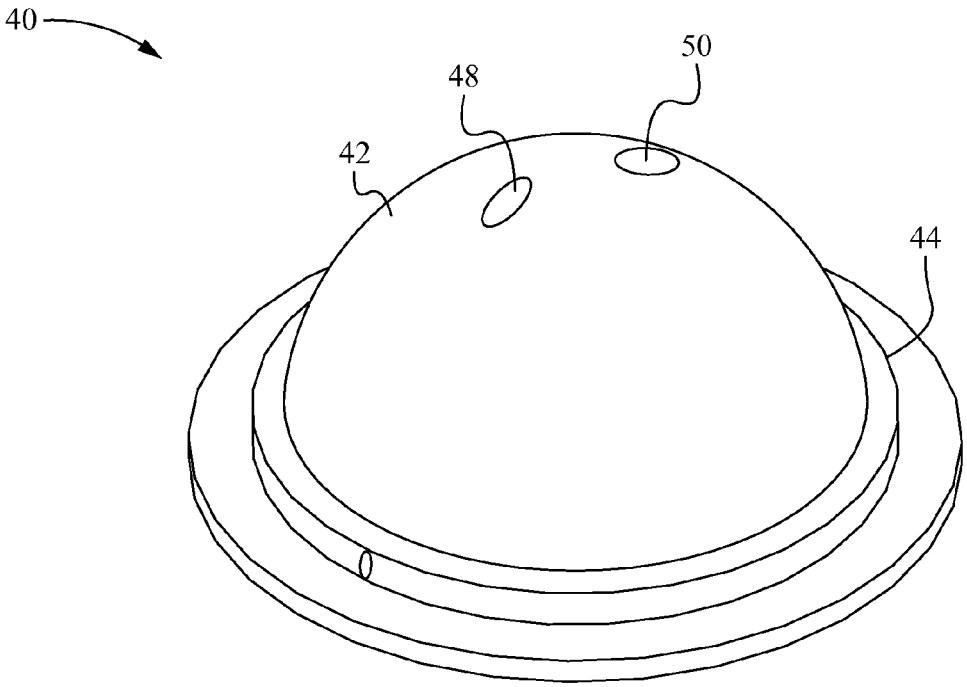
FIG. 4 illustrates a top down perspective view of an exemplary evaporator having a hemispherical configuration according to an embodiment.
Figure 5:
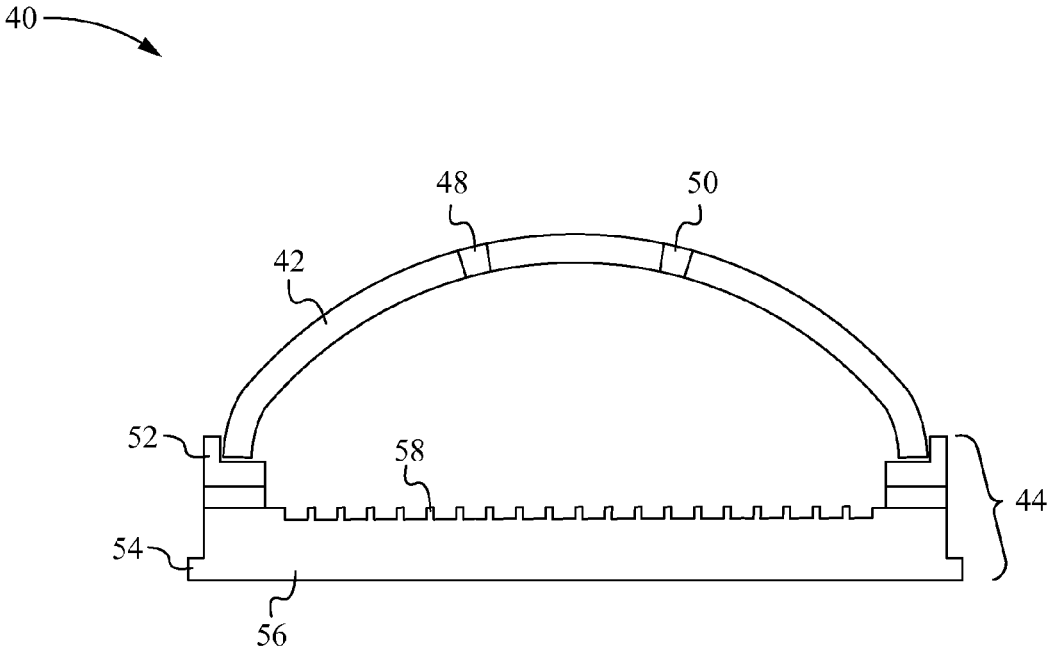
FIG. 5 illustrates a cut out side view of the evaporator of FIG. 4.

As shown in FIGS. 1-3, the evaporator 14 has planar surfaces as in a rectangle or other trapezoidal configuration. Alternatively, the evaporator is configured as a hemispherical evaporator. A hemispherical design mimics the geometry of a pressure vessel with its spherical based shape. Such an evaporator configuration provides significantly improved hoop strength. In some embodiments, the bottom side of the evaporator remains planar in order to interface with a planar light source. In other embodiments, the bottom side is contoured to match some or all of a non-planar thermal exchange surface of the light source. Regardless of the bottom side configuration, at least an upper portion of the evaporator can have a hemispherical configuration. FIG. 4 illustrates a top down perspective view of an exemplary evaporator 40 having a hemispherical configuration according to an embodiment. FIG. 5 illustrates a cut out side view of the evaporator 40 of FIG. 4. The evaporator 40 includes an upper spherical casing 42 coupled to a lower base 44. The upper spherical casing 42 includes one or more openings. In the exemplary configuration shown in FIG. 4 there are two openings 48 and 50. Each opening is coupled to a vertically ascending pipe. For example, the opening 48 is coupled to the vertically ascending pipe 26 (FIG. 2) and the opening 50 is coupled to the vertically ascending pipe 16 (FIG. 2). The lower base 44 includes a support portion 52 configured to receive the upper spherical casing 42. The lower base 44 also includes a thermal interface plate 54. The thermal interface plate 54 includes an outer surface 56 and an inner surface 58. The outer surface 56 is thermally coupled to the light source. In some embodiments, the outer surface 56 is planer, as shown in FIG. 5. In other embodiments, the outer surface is non-planar and is configured to match some or all of a surface contour of the light source. In some embodiments, the lower base 44 has a circular configuration, as shown in FIG. 4. The lower base 44 can also include additional threaded attachments for the light source, such as an external ring when the lower base has a circular shape. In other embodiments, the lower base is alternatively shaped. The inner surface 58 is configured to promote nucleate boiling of the fluid. In some embodiments, the inner surface 58 has an arrangement of fins and/or divots. In some embodiments, the inner surface 58 includes a specialized surface finish that promotes nucleate boiling.

In some embodiments, the upper spherical casing 42 and the lower base 44 are designed with an interface that allows them to be made with different processes to optimize costs. The separation of the upper spherical casing and the lower base allows the upper portion to be cast, for example, while the lower base is machined, for example, to achieve higher precise and more optimal heat transfer.

In an exemplary application, the lighting assembly is designed for high bay lighting, such as 40-50 feet high ceilings. In such an application, the lighting assembly generates 100-400 watts. In some applications, the lighting assembly generates more than 400 watts. In general, the lighting assembly is useful for those applications requiring lighting solutions with higher wattages than those found in typical office environments having 8-10 feet high ceilings.

Figure 8:
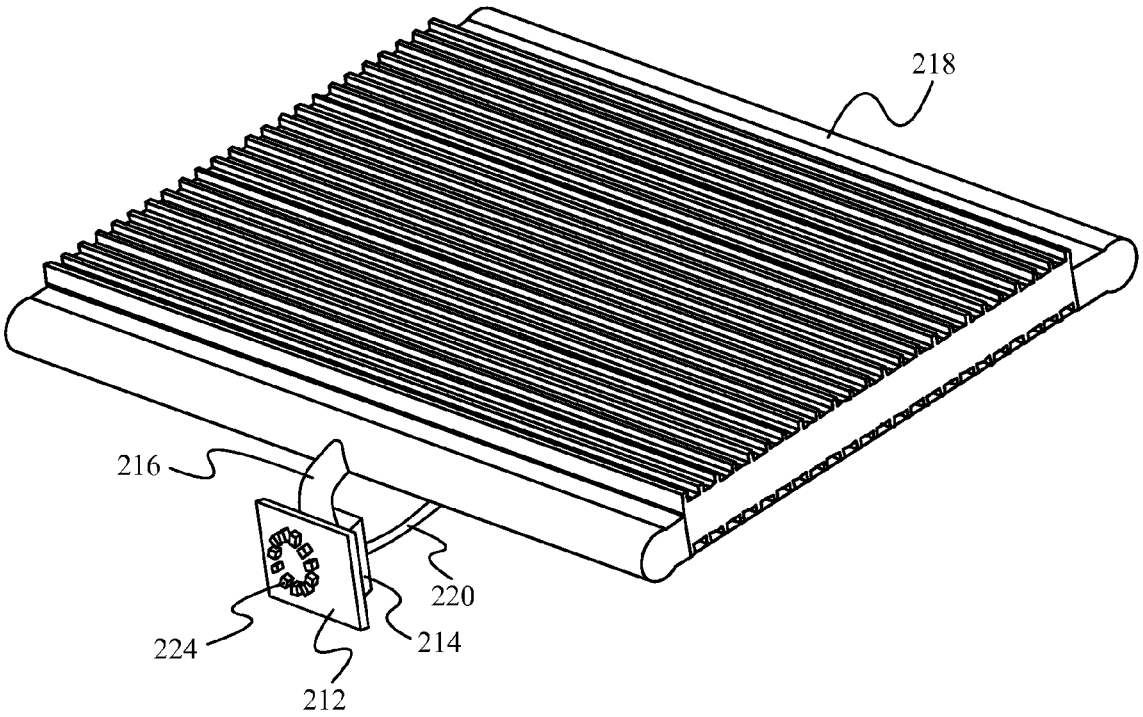
FIG. 8 illustrates a perspective view of a lighting assembly configured for a vertically mounted light source according to an embodiment.
Figure 9:
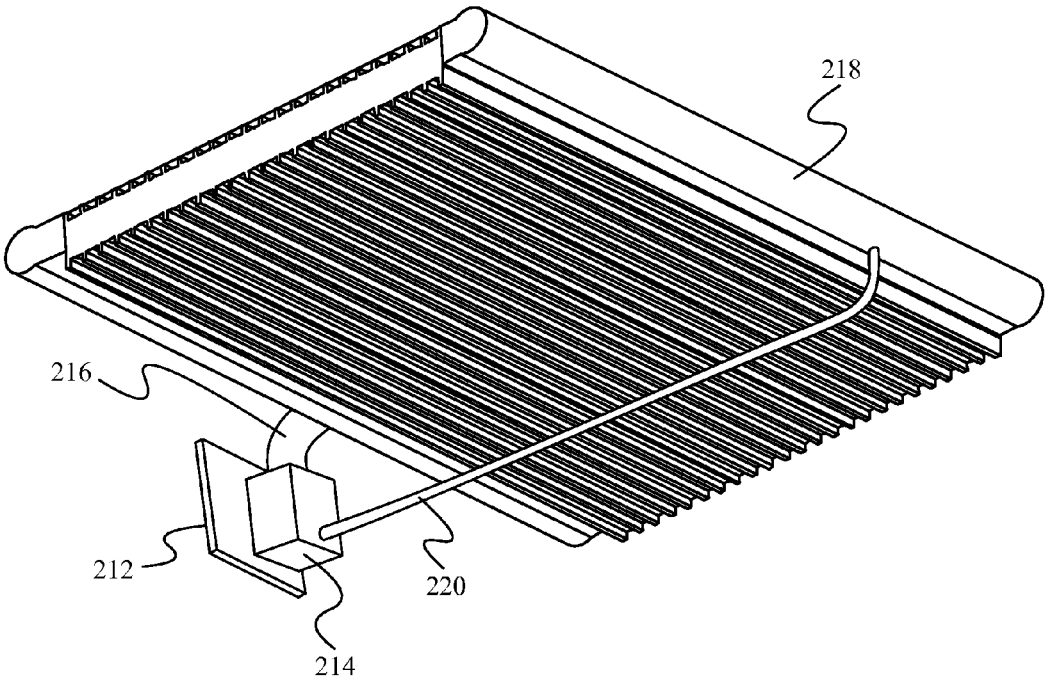
FIG. 9 illustrates an alternative perspective view of the lighting assembly of FIG. 8.

In other applications, it is advantageous to mount the light source vertically so as to provide a horizontal projection of light emitted by the light source, such as in an automotive headlight application. In some embodiments, vertically mounting the light source necessitates a modification of the lighting assembly. FIG. 8 illustrates a perspective view of a lighting assembly configured for a vertically mounted light source according to an embodiment. FIG. 9 illustrates an alternative perspective view of the lighting assembly of FIG. 8. The lighting assembly includes a vertically mounted light source, device electronics and a cooling system. The cooling system is a closed loop cooling system that includes an evaporator, a vertically ascending pipe, a radiator and a return pipe. The exemplary cooling system shown in FIGS. 8 and 9 includes an evaporator 214, a vertically ascending pipe 216, a radiator 218, and a return pipe 220. The cooling loop of FIGS. 8 and 9 functions similarly as the cooling loops of FIG. 1 to provide cooling for the light source. The evaporator 214 is configured such that a side surface is the thermal exchange surface for transferring heat from the light source, as opposed to a bottom surface as in previous embodiments. In the exemplary configuration shown in FIGS. 8 and 9, the side thermal exchange surface of the evaporator 214 is configured and aligned on an opposing side of the PCB 212 than the LEDs 224. Alternatively, the side thermal exchange surface of the evaporator 214 is configured and aligned such that the side thermal exchange surface is in thermal contact with the entire back side of the PCB 212. As shown in FIGS. 8 and 9, the side thermal exchange surface is a rectangular, planar surface. Alternatively, the surface can be shaped other than a rectangle. Preferably, the shape of the thermal exchange surface matches that of a corresponding thermal exchange surface of the light source. The thermal exchange surface is made of a thermally conductive material, which can be the same or different than the material used to make the remainder of the evaporator. The light source can be thermally coupled to the thermal exchange surface via a thermal interface material.

The evaporator 214 is a fluid-based heat exchanger that conceptually functions as a boiling unit. In some embodiments, the evaporator 214 includes a fluid reservoir that is filled or partially filled. In some embodiments, a fluid level within the evaporator is at least as high as the highest edge of the light source. For example a fluid level in the evaporator 214 is at least as high as the top edge of the LEDs 224. The evaporator 214 is thermally coupled to the light source such that heat generated by the light source is transferred to the fluid within the evaporator 214. The heat causes fluid in the evaporator 14 to boil. The resulting vapor rises through the vertically ascending pipe 216 to the radiator 218. In some embodiments, the configuration of the fluid and the vertically ascending pipe 216 enables a pumping means whereby the boiling fluid, including vapor and liquid, rise from the evaporator 214, through the pipe 216, and to the radiator 218 in a manner previously described.

The radiator 218 is aligned at a decline, or downward angle relative to horizontal, such that one end is higher than the other end. The pipe 216 is coupled to a top portion of the radiator 218 and the return pipe 220 is coupled to a bottom portion of the radiator 218. In some embodiments, the pipe 216 is coupled to an end of the top portion of the radiator 218. In some embodiments, the return pipe 220 is coupled to an end of the bottom portion of the radiator 218. Vapor entering the radiator 218 from the pipe 216 condenses and the liquid flows downward through the radiator 218 to the return pipe 220. Due to the declining orientation of the radiator 218, liquid within the radiator is gravity fed toward the bottom end and to the return pipe 220. The return pipe 220 is aligned at a decline such that one end is higher than the other end such that liquid received from the radiator 218 is gravity fed to the evaporator 214.

The radiator 218 can include an input header coupled to the pipe 216. The input header laterally distributes the vapor received from the pipe. The radiator can also include one or more fluid conduits coupled to the input header and fins coupled to the fluid conduits. The fluid conduits can be arranged laterally and/or layered to form a vertical stack of fluid conduits, each layer separated by fins. The radiator 218 can also include an output header coupled to the one or more fluid conduits. The output header is coupled to the return pipe. In general, the radiator 218 is designed to dissipate the heat to the atmosphere using convection cooling without the need for fans blowing over the radiator.

As described above, the light source can be a plurality of LEDs mounted to a PCB. PCBs are inherently flexible. Attaching such a flexible substrate to a rigid thermal exchange interface and achieving the requisite thermal interface between the two may require many fasteners, both along the perimeter and interior of the PCB. The PCB can be modified for enhanced rigidity, as described above.

In the configuration shown in FIGS. 8 and 9, device electronics are included as part of a PCB 212. It is understood that device electronics separate from the light source, such as the device electronics in FIGS. 1-2 and 6-7, can be added to the lighting assembly of FIGS. 8 and 9.

In some embodiments, power is supplied via an external power supply cable coupled to the PCB 212. In other embodiments, the lighting assembly of FIGS. 8 and 9 includes one or more power supplies such as the power supplies described in relation to FIGS. 1-2 and 6-7.

In some embodiments, the lighting assembly of FIGS. 8 and 9 includes a mounting structure. However, for simplicity the mounting structure is not shown in FIGS. 8 and 9. In the exemplary automotive headlight application a mounting structure can include any conventional mounting mechanisms for mounting and/or providing support to the radiator and/or the evaporator to a frame or other support element on the automobile. Alternatively, a mounting structure similar to those described above in relation to FIGS. 1-7 can be used.

The present application has been described in terms of specific embodiments incorporating details to facilitate the understanding of the principles of construction and operation of the lighting assembly. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A lighting assembly for cooling a light source, the lighting assembly comprising:

a. a light source having a vertically aligned thermal exchange surface;

b. an evaporator having a side thermal exchange surface thermally coupled to the vertically aligned thermal exchange surface of the light source, wherein the evaporator comprises a reservoir and a fluid within the reservoir, the evaporator is configured such that at least a portion of the fluid is vaporized by heat transferred from the light source; and c. a cooling loop coupled to the evaporator, wherein the cooling loop comprises a transfer pipe coupled to the evaporator, a radiator coupled to the transfer pipe, and a return pipe coupled to the radiator and to the evaporator, wherein the return pipe includes a first end coupled to the radiator and a second end coupled to the evaporator, the return pipe is configured and aligned having the first end of the return pipe positioned higher than the second end of the return pipe and an entirety of the return pipe is positioned higher than a bottom surface of the evaporator thereby enabling gravity feeding of fluid from the radiator to the evaporator, further wherein the radiator is configured to receive vapor from the evaporator via the transfer pipe and to condense the vapor to fluid, and the radiator is configured to gravity feed the fluid to the return pipe.

2. The lighting assembly of claim 1 wherein the fluid comprises a fluid mixture having at least a first fluid and a second fluid having a higher boiling temperature than the first fluid, wherein the first fluid comprises the portion of the fluid vaporized by heat transferred from the light source.

3. The lighting assembly of claim 2 wherein the evaporator and the fluid mixture are configured such that when the portion of the fluid is vaporized by heat transferred from the light source a boiling fluid is formed, further wherein the evaporator and the transfer pipe are configured such that the boiling fluid is siphoned from the evaporator to the radiator.

4. The lighting assembly of claim 1 wherein the light source comprises a plurality of light emitting diodes.

5. The lighting assembly of claim 4 wherein the light source further comprises a printed circuit board coupled to the plurality of light emitting diodes.

6. The lighting assembly of claim 1 wherein the radiator includes a first end coupled to the transfer pipe and a second end, and the radiator is aligned along a non-horizontal plane with the first end positioned higher than the second end.

7. The lighting assembly of claim 1 wherein the transfer pipe is configured to be vertically ascending.

8. The lighting assembly of claim 1 wherein the radiator comprises a finned radiator.

9. The lighting assembly of claim 1 wherein the light source is aligned to emit a horizontal projection of light.

10. The lighting assembly of claim 1 wherein a fluid level of the fluid in the reservoir is at least as high as a highest vertical point of the light source.

11. A lighting assembly for cooling a light source, the lighting assembly comprising:

a. a light source having a vertically aligned thermal exchange surface;

b. an evaporator having a side thermal exchange surface thermally coupled to the vertically aligned thermal exchange surface of the light source, wherein the evaporator comprises a reservoir and a fluid within the reservoir, the evaporator is configured such that at least a portion of the fluid is vaporized by heat transferred from the light source;

c. a transfer pipe coupled to the evaporator such that vapor formed in the evaporator rises through the transfer pipe;

d. a radiator coupled to the transfer pipe, wherein the radiator includes a first end coupled to the transfer pipe and a second end, and the radiator is aligned along a non-horizontal plane with the first end positioned higher than the second end, further wherein the radiator is configured such that vapor received from the transfer pipe is condensed to fluid and the fluid is gravity fed to the second end; and e. a return pipe coupled to the radiator, wherein the return pipe includes a first end coupled to the second end of the radiator and a second end coupled to the evaporator, the return pipe is configured and aligned having the first end of the return pipe positioned higher than the second end of the return pipe and an entirety of the return pipe is positioned higher than a bottom surface of the evaporator such that fluid output from the second end of the radiator is gravity fed to the evaporator.

12. The lighting assembly of claim 11 wherein the fluid comprises a fluid mixture having at least a first fluid and a second fluid having a higher boiling temperature than the first fluid, wherein the first fluid comprises the portion of the fluid vaporized by heat transferred from the light source.

13. The lighting assembly of claim 12 wherein the evaporator and the fluid mixture are configured such that when the portion of the fluid is vaporized by heat transferred from the light source a boiling fluid is formed, further wherein the evaporator and the transfer pipe are configured such that the boiling fluid is siphoned from the evaporator to the radiator.

14. The lighting assembly of claim 11 wherein the light source comprises a plurality of light emitting diodes.

15. The lighting assembly of claim 14 wherein the light source further comprises a printed circuit board coupled to the plurality of light emitting diodes.

16. The lighting assembly of claim 11 wherein the transfer pipe is configured to be vertically ascending.

17. The lighting assembly of claim 11 wherein the radiator comprises a finned radiator.

18. The lighting assembly of claim 11 wherein the light source is aligned to emit a horizontal projection of light.

* * * * *